US007357390B2

(12) United States Patent
Bolza-Schünemann

(10) Patent No.: US 7,357,390 B2
(45) Date of Patent: Apr. 15, 2008

(54) DEVICES FOR ALIGNING SHEETS AND A METHOD FOR ALIGNING SHEETS TRANSVERSAL TO THE DIRECTION OF TRAVEL OF THE SHEETS

(75) Inventor: Hans-Bernhard Bolza-Schünemann, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 399 days.

(21) Appl. No.: 10/510,230

(22) PCT Filed: Feb. 23, 2003

(86) PCT No.: PCT/DE03/00672

§ 371 (c)(1),
(2), (4) Date: Oct. 13, 2004

(87) PCT Pub. No.: WO03/086923

PCT Pub. Date: Oct. 23, 2003

(65) Prior Publication Data

US 2005/0179196 A1 Aug. 18, 2005

(30) Foreign Application Priority Data

Apr. 13, 2002 (DE) ..... 102 16 355

(51) Int. Cl.
*B65H 9/16* (2006.01)

(52) U.S. Cl. ..... 271/250; 271/94

(58) Field of Classification Search ..... 271/226, 271/227, 248, 249, 250, 251, 252
See application file for complete search history.

(56) References Cited

U.S. PATENT DOCUMENTS

| | | | | |
|---|---|---|---|---|
| 1,728,329 | A | 9/1929 | Broadmeyer | |
| 2,167,823 | A | 8/1939 | Backhouse | |
| 2,422,629 | A * | 6/1947 | Muller et al. | 112/21 |
| 2,712,936 | A * | 7/1955 | Backhouse | 271/252 |
| 3,178,176 | A * | 4/1965 | Peyrebrune | 271/252 |
| 3,791,642 | A | 2/1974 | Schunemann | |
| 4,184,673 | A * | 1/1980 | Weisbach | 271/237 |
| 4,245,831 | A * | 1/1981 | Michatek | 271/171 |
| 4,345,752 | A * | 8/1982 | Nakamura et al. | 271/12 |
| 4,430,937 | A * | 2/1984 | Hubner | 101/232 |
| 4,615,520 | A * | 10/1986 | Jeschke et al. | 271/227 |

(Continued)

FOREIGN PATENT DOCUMENTS

DE 653308 11/1937

(Continued)

*Primary Examiner*—Patrick Mackey
*Assistant Examiner*—Kalyan Kumar
(74) *Attorney, Agent, or Firm*—Jones, Tullar & Cooper, PC

(57) ABSTRACT

A device is provided for use in the alignment of sheets transverse to a direction of sheet travel. A sheet retaining device, which conveys the sheets, is displaceably mounted for holding the sheets against a side guide. At least two sheets are situated one above the other in an offset manner in the direction of sheet travel. An effective retaining surface extends in the direction of sheet travel and has a longitudinal length greater than a transverse width. A ratio of the longitudinal length of the effective retaining surface to the width of the transverse width of the effective retaining surface is greater than three.

12 Claims, 5 Drawing Sheets

U.S. PATENT DOCUMENTS

| | | | | | |
|---|---|---|---|---|---|
| 4,643,414 | A | * | 2/1987 | Weisgerber | 271/183 |
| 4,696,465 | A | * | 9/1987 | Willi | 271/237 |
| 4,702,469 | A | * | 10/1987 | Jeschke et al. | 271/227 |
| 4,940,221 | A | * | 7/1990 | Wirz et al. | 271/107 |
| 5,542,659 | A | * | 8/1996 | Haupenthal | 271/108 |
| 5,624,111 | A | * | 4/1997 | Maass | 271/236 |
| 6,446,959 | B2 | * | 9/2002 | Butterfass et al. | 271/226 |
| 6,505,831 | B2 | * | 1/2003 | Henn et al. | 271/227 |
| 2001/0006274 | A1 | * | 7/2001 | Butterfass et al. | 271/250 |

FOREIGN PATENT DOCUMENTS

| | | | |
|---|---|---|---|
| DE | 1110656 | | 2/1962 |
| DE | 27 35 711 | A1 | 3/1978 |
| DE | 27 17 554 | A1 | 8/1978 |
| DE | 33 02 873 | C2 | 5/1987 |
| DE | 33 05 219 | C2 | 11/1989 |
| DE | 198 22 307 | A1 | 1/1999 |
| DE | 100 55 584 | A1 | 6/2001 |
| JP | 51-34764 | | 9/1976 |
| JP | 54-22537 | | 8/1979 |

* cited by examiner

DEVICES FOR ALIGNING SHEETS AND A METHOD FOR ALIGNING SHEETS TRANSVERSAL TO THE DIRECTION OF TRAVEL OF THE SHEETS

CROSS REFERENCE TO RELATED APPLICATIONS

This application is the U.S. national phase, under 35 USC 371, of PCT/DE03/00672, filed Feb. 28, 2003; published as WO 03/086923 A2 and A3 on Oct. 23, 2003, and claiming priority to DE 102 16 355.3, filed Apr. 13, 2002, the disclosures of which are expressly incorporated herein by reference.

FIELD OF THE INVENTION

The present invention is directed to devices for aligning sheets and to a method for aligning sheets transversely to the direction of travel of the sheets. A holding device, which transports a sheet, is arranged to move the sheet against a side mark.

BACKGROUND OF THE INVENTION

Pull guides are known in various embodiments, which guides pull each sheet, mainly by static friction, against a fixed stop, the actual side mark. After arriving at the side mark, the sheet can immediately come to rest, because the pulling mechanism, which is only in slight contact with it, continues to pull on the sheet. However, the static friction immediately is switched to sliding friction.

Driven pulling rails, pulling rollers or pulling segments are used in a sheet-feeding table. If the sheet has arrived at the front marks, it is first pushed from above on the driven portion of the pulling device underneath the sheet by the use of a roller, which can be precisely adjusted, which roller is spring-loaded and which is cyclically moved up and down. The length of the pull of the pull guide is always slightly greater than the scatter width of the incoming scaled layers of sheets, plus a minimum pulling length of a few millimeters, up to the fixed side mark stop. The latter is adjustably fastened on the sheet-feeding table or on the comb plate, depending on the sheet format and the desired lateral position of the sheets running into the printing press.

These known pull guides have the disadvantage that they clamp the sheet from above and below in the course of pulling it. For this reason, the pull guide must remain open at the end of the pulling operation until each sheet end has passed the pull guide line, i.e. until each sheet end has cleared it. Only then can the successive sheet, which is already located in the front marks, be pulled by the pull guide. The third sheet of the incoming stream of scaled sheets must be sufficiently remote from the front marks and the pull guide line so that it has not yet reached the clamping pull guide working on the second sheet, i.e. is closed.

For rapidly running sheet printing presses, it is customary to keep the plate cylinder and the rubber blanket cylinder as small as possible. In that case, the paper running times are shorter, and the manufacturing expenses are less. The sheet length often can be ¾ to ⅚ of the plate cylinder circumference, so that the cylinder grooves are short and the sheets follow each other very closely. Clamping pull guides can no longer function, because the long sheets clear the pull guide lines too late for the clamping pull guides to pull the next sheet. In these cases, suction pull guides are used, in which suction pull guides the pressure roller extending down from above, is omitted.

A driven suction pull guide strip is located in the feed table and pulls each sheet in by the provision of a sufficient number of small suction air holes, and pulls each sheet transversely, in relation to the running direction of the sheets, against a fixed side mark. In this case, the suction air is adjusted so finely, for each paper thickness up to cardboard, that each sheet is pulled by the suction orifice against the side mark by the use of static friction and is deposited there, while the sliding friction, which now starts automatically, allows the further movement of the suction strip up to dead center.

Thus, known suction pull guides only act on the sheet from below without any clamping effects. They make possible an operation in the covered state of the preceding sheet end, and therefore accomplish greater sheet output per hour than prior clamping pull guides. However, it is disadvantageous that the third successive sheet, which is moved in underneath the sheet to be aligned in the scaled flow, must not reach the working pull guide, the same as with clamping pull guides, because it cannot get through between the second sheet that is grasped by suction, and the suction orifice. It can only do so if the suction pull guide does not operate, i.e. if the suction pull guide is "open" for sheets moving up from below.

The disadvantages of the generally known clamping and suction pull guides for the lateral alignment of sheets could be avoided if a lateral pulling device operating from above were provided.

DE 33 05 219 C2 describes the employment of a suction pull guide for very short scale distances, which suction pull guide is operating from above.

A device for the lateral alignment of sheets is known from DE 100 55 564 A1. An effective suction surface is greater in the conveying direction of the sheets than in the transverse direction.

DE 33 02 873 C2 discloses a suction gripper acting from above, which suction gripper is lifted for further conveying a successive sheet underneath the sheet which is just to be aligned.

DE 11 10 656 B shows a back-and-forth pivotable suction segment for the lateral alignment of sheets.

U.S. Pat. No. 2,167,823 discloses a device for aligning sheets transversely with respect to the sheet running direction. A holding device for transporting a sheet is arranged to move the sheet against a side mark, and at least two sheets are arranged on top of each other in a scaled manner in the sheet running direction. An effective holding surface extends in the sheet running direction, which surface is longer in the longitudinal direction than in the transverse direction, and wherein the holding device is arranged for acting from above on the sheet. In this case, three sheets are simultaneously arranged in the area of the holding device.

DE 2735 711 A1 shows a device for the lateral alignment of sheets by the use of a suction strip acting from below.

DE 27 11 554 A1 and DE 653 308 C each describe a device for aligning sheets. An end of an already aligned sheet trailing in the sheet running direction is again moved away from a side mark transversely to the sheet running direction.

DE 198 22 307 A1 discloses a device for aligning sheets transversely in respect to the sheet running direction. A transport roller, which transport the sheet from underneath, moves the sheet against a side mark and perform 1/N revolutions per sheet to be aligned.

A device for the lateral alignment of sheets by the use of circulating suction rollers acting from above is known from U.S. Pat. No. 1,728,329.

SUMMARY OF THE INVENTION

The object of the present invention is directed to providing devices for aligning sheets, and to providing a method for aligning sheets transversely to the direction of travel of the sheets.

In accordance with the present invention, this object is attained by the provision of a device for aligning sheets transversely to a sheet running directiong. A holding device, which transports the sheet form above, is used to move the sheet against a side register mark. At least two sheets are arranged above each other in a scaled fashion in the sheet running direction. The holding device is provided in the form of at least one suction roller which is rotatable. The suction roller may make one half turn for each sheet to be aligned. The suction roller has a plurality of segments with suction holes. Each segment pulls up a different sheet to be aligned, by suction.

The advantages to be gained by the present invention lie, in particular, in that a suction pull arrangement, which acts from above, operates without clamping effects. It allows, for the first time, the passage underneath the pull guide line by the following sheet while the pull guide still pulls a previous sheet, which has been placed against the front marks, laterally against a fixed lateral edge stop.

By virtue of the provision and use of the novel "suction pull guides from above", of the present invention, the sheets can run in an advantageous manner at very close scale distances, i.e. they can run considerably slower, on the feed table to the front marks and reach them at an earlier time, because there is no longer an entering blockage for the sheets. The pull guide line is always open, because all clamping effect toward the bottom to the feed table is missing. Because of the early arrival of the sheets at the front marks, considerably longer time frames are available for sheet front and lateral edge alignment. This permits correspondingly higher machine speeds, without keeping the actual alignment times in milliseconds shorter than customary.

In a further embodiment of the "suction pull guide from above", in accordance with the present invention, it can be combined with the small lateral offset, which is known per se, of the sheets entering the printing press. In this case, the suction pull guide from above can operate, even if the sheet end of the previous sheet still covers the pull guide line, while simultaneously a successive sheet also passes underneath the pull guide line. In this novel way, there are not only two sheets, as has been the case up to now, but three sheets simultaneously in the area of the pull guides. This explains how, in spite of considerably greater numbers of revolution of the press, identical or longer sheet alignment times are made available by the provision of suction pull guides which operate from above.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
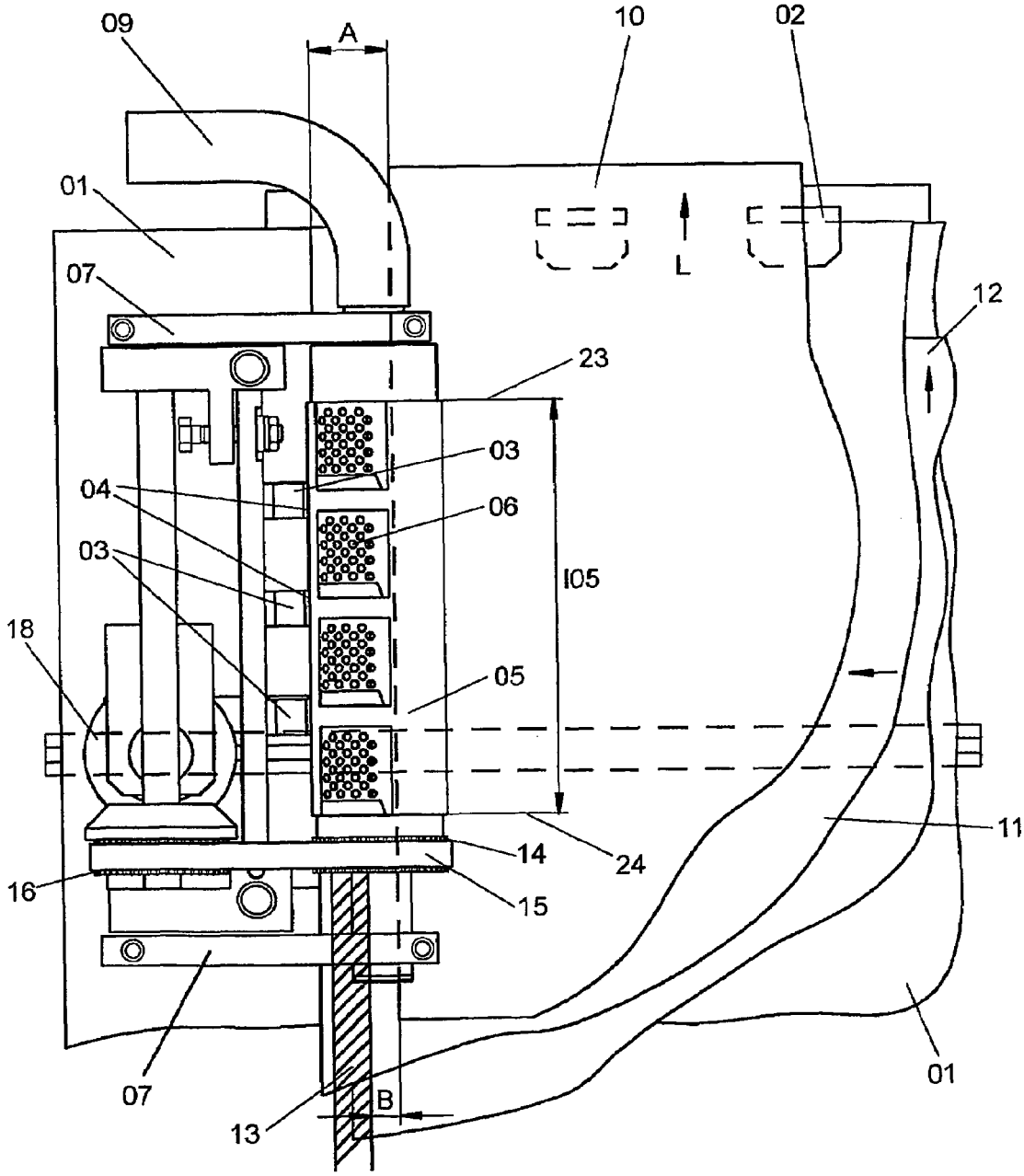
FIG. 1, a top plan view of the left corner of a feed table in accordance with the present invention, in FIG. 2, a cross-section through the suction pull guide in the feed table, in FIG. 3, a side elevation view, partly in cross-section of the drive mechanism of the shiftable suction roller, in FIG. 4, a way/time diagram of the sheet feeding device with a classic pull guide, and in FIG. 5, a way/time diagram of the sheet feeding device with the side mark in accordance with the present invention.

Several front marks 02 are located on a feed table 01 in FIG. 1, which open toward the bottom. There are side marks 03 with cover marks 04. The cover marks 04 are located underneath a suction roller 05 and in the grooves of the suction roller 05. The suction roller 05 has two diametrically oppositely located rows of suction holes 06, of which the upper row of suction holes 06 is visible in FIG. 1. The suction roller 05 has axle journals that rotate in two bearing arms 07, which are adjustably fastened on the feed table outside of the paper format. Suction air is conducted into the suction roller 05 through a hose 09 and is conducted to the inside of the suction tube wall by a slit mouthpiece 22, which can only be seen in FIG. 2. The axis of rotation of the suction roller 05 is located parallel with the running direction L of the sheets. The suction roller 05 is positioned in the vicinity of the lateral sheet edge to be aligned, as seen in FIG. 1. Driving of the suction roller 05 for rotation about its axis of rotation is provided, as seen in FIGS. 1 and 3, via a toothed belt pulley 14, a toothed belt 15 and a pinion 16 of a constant speed shaft located in the sheet delivery device or on the printing press or, for example, via its own rpm- or positionally- regulated electric drive mechanism by the use of an electronic shaft.

Figure 2:
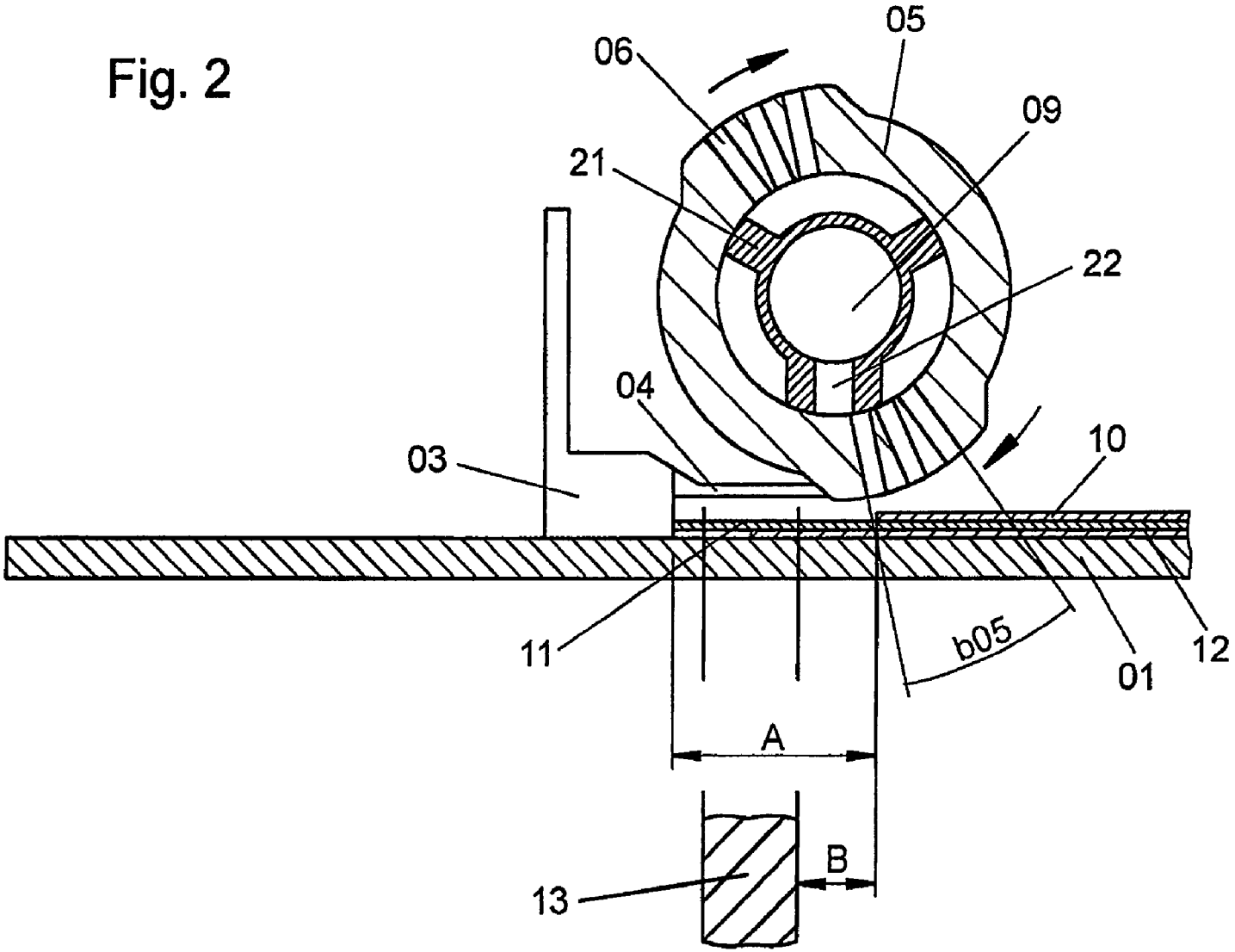
Figure 3:
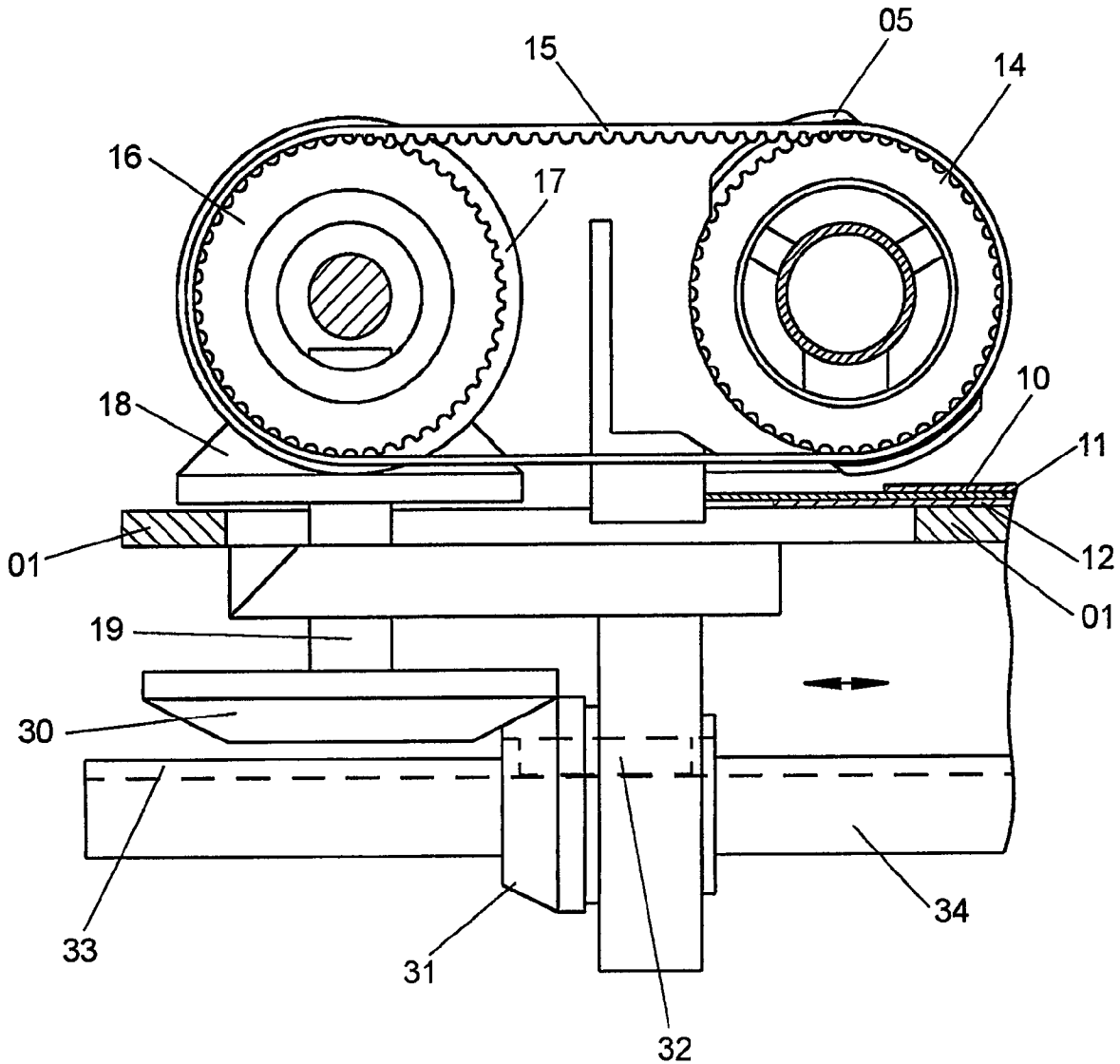

In accordance with the depiction of the suction roller 05 shown in FIGS. 1 to 3, the two suction hole rows 06 of the suction roller 05 are spaced so that they rotate at half turns, i.e. the suction roller 05 is arranged in such a way that it performs half a turn for each sheet 10, 11, 12 to be aligned. The suction roller 05 preferably has a diameter between 50 and 60 mm. It can also be constructed differently, for example with the suction hole rolls 06 spaced for one-third turns.

The suction roller 05 is arranged in such a way that it performs 1/N revolutions per sheet 10, 11, 12 to be aligned, wherein N=2, 3, 4 . . . , i.e. N is a whole number greater than 1.

FIG. 1 shows a sheet 10 running into the printing press via front marks 02, which sheet 10 is, after lateral alignment at side marks 03, grasped by a conventional sheet feeder, for example from below by the use of a swinging gripper, or by the use of suction-push feeders from below, while lying in the front marks 02, and is pulled off the feed table 01 under acceleration. In the course of this sheet movement, the sheet feeder is axially offset, in a direction transversely to the sheet running direction L, by an always constant amount A of, for example, 26 mm. Because of this axial offset, the narrow suction slit, which is located approximately underneath the center axis of the suction roller 05 and having a width of 6 mm, for example, is uncovered over its entire suction roller length from the lateral edge of the outrunning first sheet 10.

FIG. 1 shows that the trailing end of the sheet 10 has not yet left the area of the suction roller 05. However, the lateral displacement A of the first sheet 10 caused by the conventional sheet feeder makes it possible for the suction roller to have already actively pulled the next, second sheet 11, which is already located in the front marks 02, as seen in FIG. 1, laterally toward the left against the side marks 03. The sheet feeding of this second sheet 11 can start soon, even if the end of the first sheet 10 still covers the front marks 02.

A third sheet 12, which has already arrived in the area of the suction roller 05, slowly moves in the sheet travel direction L toward the front marks 02, also as seen in FIG. 1. Since it lies underneath the second sheet 11, which second sheet 11 is just being pulled laterally against the side marks 03 by the suction roller 05 acting from above, as seen in FIG. 2, the suction roller 05 cannot yet grasp the third sheet 12 by use of its suction. This grasping of sheet 12 by the roller 05 only takes place in the next time period, when the second sheet 11, which is now laterally displaced by the distance A by the operation of the conventional sheet feeder, in the same way as was done with the first sheet 10, and which second sheet 11 now enters into the press and uncovers the suction slit 06 in the suction roller 05 for the third sheet 12, etc. A tolerance strip 13 of, for example, ±6 mm has been drawn in FIGS. 1 and 2 in hatched lines. The individual scaled, imbricated or overlying sheets move, with this maximum amount of scattering, in the sheet running direction L, onto the feed table 01 from the sheet feeder with their leading edges moving into engagement with the front marks 02. The active narrow, but long suction conduit 06 of the suction roller 05, which is located above the stream of sheets, is located underneath the center line of the suction roller 05, and between the sheet inlet tolerance strip 13 and the lateral edge of all of the arriving lateral sheet edges, which lateral sheet edges are subsequently offset, by the amount A, from the side marks 03 as they depart the feed table 01. This tolerance strip is the strip identified by B in FIGS. 1 and 2. With this arrangement, the suction roller 05 catches all sheets 10, 11, 12 of the scaled stream arriving inside the tolerance strip 13, but not the offset lateral edges of all incoming sheets 10, 11, 12 after they are offset by the distance A as they leave the feed table 01.

The ratio of the effective holding surface, in the longitudinal direction l05, to the effective holding surface, in the transverse direction b05, of the suction roller 05 should be greater than 3, and preferably should be greater than 5.

The three sheets 10, 11, 12 are arranged between two straight lines 23, 24, which straight lines 23, 24 delimit the effective holding surface of the holding device, such as the suction roller 05 and which straight lines 23, 24 extend transversely with respect to the running direction L of the sheets.

FIG. 2 shows the suction roller 05 located above the feed table/comb plate 01. The first sheet 10 enters the press, as it exits from the feed table 01, offset from the side mark 03 by the distance A, for example 26 mm. Sheet 10 lies to the right of the suction roller center outside of the suction air slit mouthpiece 22.

The second sheet 11, which is entering the feed table 01, is pulled laterally against the side mark 03 by one of the two raised suction air segments with suction holes 06 of the suction roller 05. Several cover marks, or guide tongues 04, project past the side marks 03 into the grooves of the suction roller 05 as far as approximately the center underneath the suction roller 05. The cover marks 04 prevent thin sheets 10, 11, 12 from arching in the nip formed between the feed table 01, the side mark 03 and the suction roller 05 when these sheets are coming into contact with the side marks 03.

The two active suction hole segments 06 of the suction roller 05 are located diametrically opposite each other and, with a suction roller 05 revolving at half turns, are approximately 30° to 40° in arcuate length, so that a long pulling time angle of approximately 90° and a pulling path of the suction roller 05 of approximately 20 mm results.

The revolving suction roller 05 itself can provide the clocked, or timed switching on and off of the suction air for lateral pulling. For this purpose, suction air holes 06 are only located in the two oppositely placed 30° to 40° segments. A stationary pipe 21 is located inside the revolving suction roller 05, and acts as the suction air supply over the entire length of the suction roller 05. The pipe 21 has a downward oriented air slit or slit mouthpiece 22 of a width of, for example, 6 mm over the length of the suction roller 05.

It is also within the scope of the present invention that the suction roller 05 has suction holes 06 all around its periphery, that it revolves rhythmically or freely, and that the suction air is supplied in a clocked or timed manner via a slit-like mouthpiece 22 inside the suction roller 05, and which is directed downward.

In the circumferential direction, the suction roller 05 has several arcuately spaced segments with suction holes 06, wherein each segment picks up a different sheet 10, 11, 12 to be aligned by the use of suction. The suction roller 05 preferably has two segments with suction holes 06 in the circumferential direction, as depicted in FIG. 2.

Where, in accordance with FIG. 2, the cover marks/guide tongues 04 are located in the area adjacent the bottom of the suction rollers, i.e. near the suction roller grooves, the suction slit 22 in the pipe 21 is not cut through in the area of the suction roller grooves, which increases the stability of the suction pipe 21. The vacuum is switched extremely rapidly, since it is maintained in the pipe 21 and only the air holes 06 close to the slit mouthpiece 22 must be emptied or evacuated by suction. With the suction tube 05, the outer walls of the suction tube 05, between the two active suction elements 06, have been placed slightly radially inwardly. This makes it easier for the offset, exiting first sheets 10, which first sheets 10 are now running into the press, to leave the feed table 01 without interference with the outer wall of the suction tube 05 as they pass next to and parallel with the suction roller center.

In FIG. 3, the incoming third sheet 12 is located within the scale tolerance strip 13, to the right of the side mark 03 and to the left of the center of the suction roller 05, so that it lies actually in the suction area 22. However, since the second sheet 11 still lies on top of the third sheet 12, and the second sheet 11 is being pulled against the side mark 03 by the suction roller 05 from above, the third sheet 12 cannot yet be engaged by suction from the suction roller 05 because it is covered by the second sheet 11. In spite of the operating side pull mark 03, the third sheet 12 can continue to move unhindered in the sheet running direction toward the front marks 02.

FIG. 3 illustrates an example of a drive mechanism for the suction roller 05 which is located above the feed table 01, and which suction roller 05 is driven at half turns by a cooperating gear wheel or toothed belt pulley 14, toothed belt 15 and drive wheel or pinion 16. Bevel wheels or gears 17, 18 above the feed table 01 are connected by a vertical shaft 19 with 2:1 bevel wheels or gears 30, 31 underneath the feed table 01. A feather key 32 has been screwed into the bevel wheel 31 and engages a continuous groove 33 of a single turn shaft 34, which rotates transversely underneath the feed table 01. A slit, which can be covered over, is located in the feed table 01 above this single turn shaft 34 for letting the vertical bevel wheel drive shaft 19 through from below to above. In this way, the entire unit, consisting of the suction pull mark with drive mechanism, can be shifted transversely in relation to the sheet running direction L, depending on the sheet width, to S1 or control side or, with a mirror-reversed suction pull mark unit, to S11 or drive side of the printing press.

It can also be seen in FIG. 3 that, for gaining sheet-feeding time, three sheets are, in accordance with the present invention, simultaneously present in the pull mark area in a novel way, while in the previous, customary way there have been only two sheets up to now.

Figure 4:
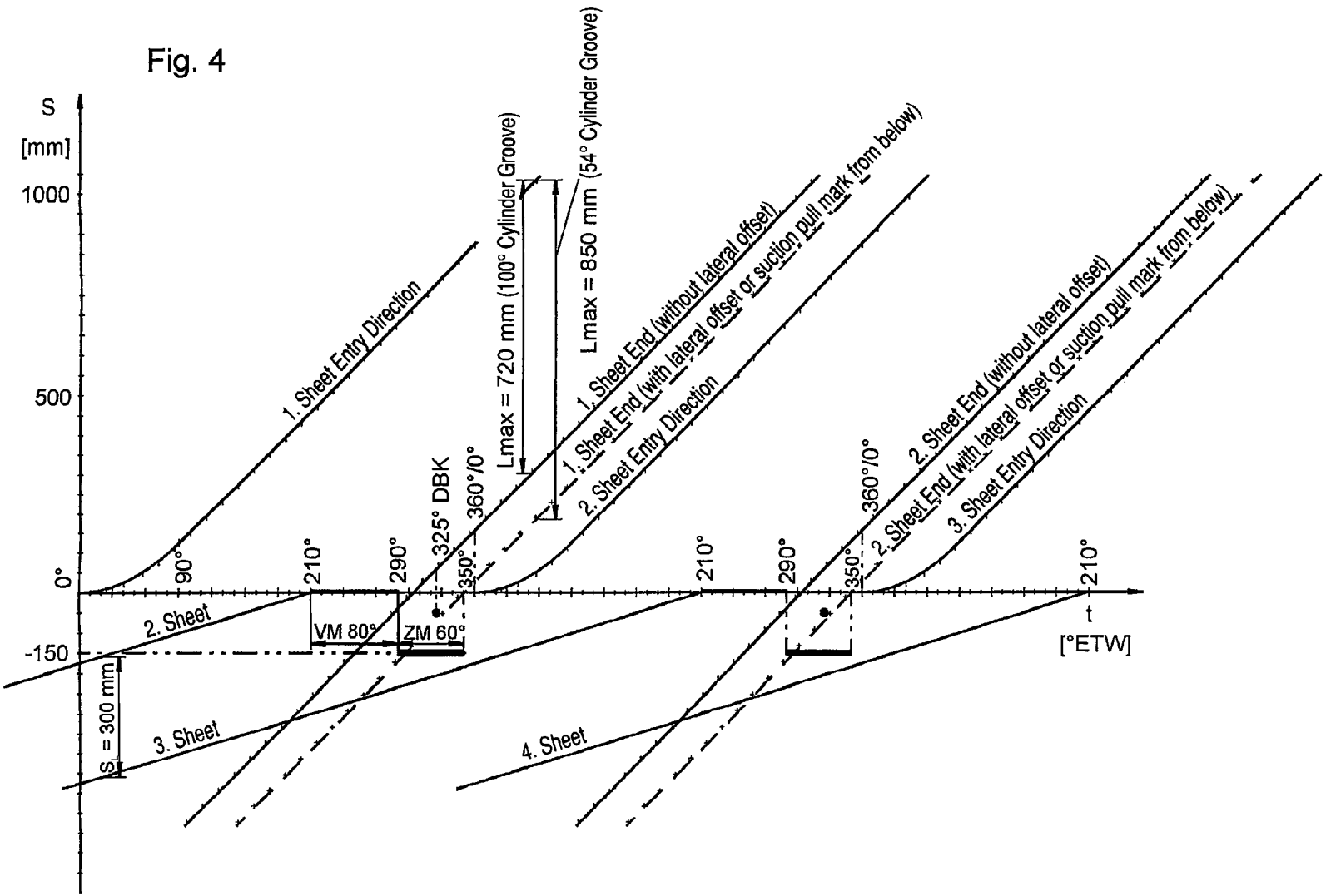

FIG. 4 represents a way/time diagram of the sheet feeding device with a classic or prior art pull guide ZM in a position of −150 mm from the zero line. The abscissa describes the active time angle of a single turn shaft, for example of a plate cylinder, from 0° to 360°, the ordinate shows the sheet travel in mm.

The first sheet at the left outside is accelerated in the 90° time angle, for example by the use of swinging auxiliary grippers, in a parallel manner to the circumferential speed of the cylinder, and leaves the front mark line in the form of a 45° straight line equal to the abscissa.

A second sheet runs more slowly in the sheet stream with a scale length SL=300 mm and encounters the front marks at 210°. It is in contact with the front mark over 80°, i.e. until 290°. Then the classic lateral pull mark is engaged, which had already been released from the outgoing first sheet of a maximal length of 720 mm. The pulling time is 60° until the pull mark opens at 350°. Only then is the third sheet 12 allowed to pass through the pull mark line −150 mm of the front marks which, with a 210° arrival point forces, the relatively large scale distance of SL=300 mm. Sheets of excess length of, for example 850 mm length, cover the pull mark. In that case, it must be a suction pull mark from underneath.

Figure 5:
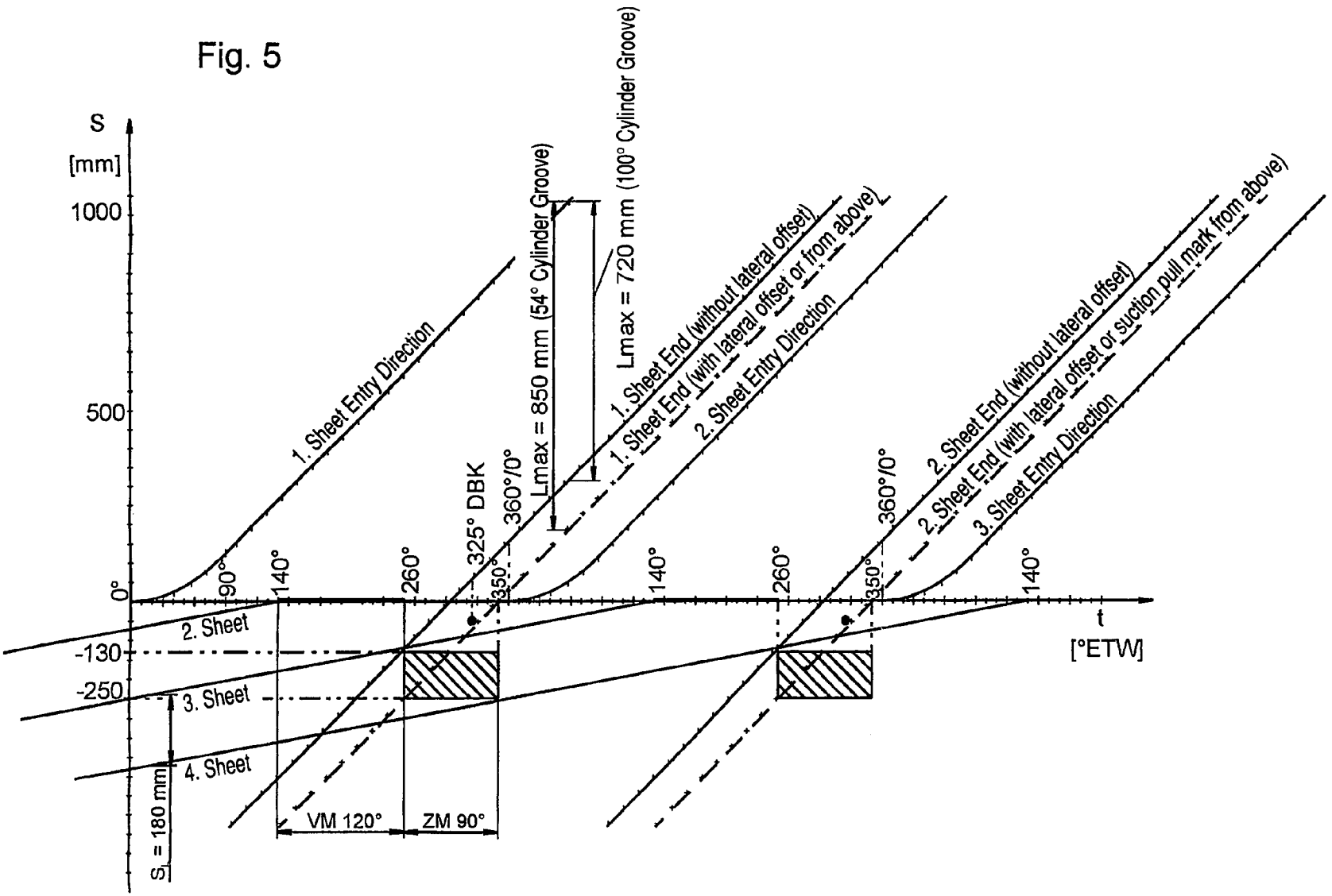

FIG. 5 represents an improved way/time diagram with the side pull mark in accordance with the present invention, which pulls the sheet by the use of suction only from above. The beginnings of the sheets and the ends of the sheets move the same as depicted in FIG. 4. The second sheet arrives considerably earlier at the front marks, namely at 140°, and has a contact time of 120° until 260° when the pull mark starts.

The scale distance SL is only 180 mm, because the third sheet need not wait for the opening of the pull mark, as was the case in FIG. 4. The third sheet 12 can pass underneath the working pull mark and can therefore already be in the 120 mm long area of the pull mark suction roller of 250 mm-130 mm. This permits the more advantageous, because it is shorter, scale distance of only 180 mm.

At a normal maximum sheet length of 720 mm, the sheet end passes the pull mark suction roller before the latter begins to operate from 260° to 350°, i.e. with a 90° pull time.

With sheets of excess length, for example 850 mm long, or 306° of 1000 mm cylinder circumference, single turn, the outgoing end covers the working suction pull mark. In such cases, the outgoing sheet must be laterally offset, for example by 26 mm, in order to release the pull mark in good time at 260°.

The comparison of FIG. 4 with FIG. 5 shows that the feed times are longer by 50%, namely at the front marks 120° instead of 80°, and at the lateral pull value 90° instead of 60°. This is possible because not only the respectively second sheet, but also already the third sheet, can be in the area between the pull mark mechanism and the front marks 02. This allows, at the same time, an advantageously short scale distance at a lesser speed and with less danger of rebound when contacting the front marks.

Which preferred embodiments of devices for arranging sheets and method for aligning sheets transversal to the direction of travel of the sheets, in accordance with the present invention, have been set forth fully and completely hereinabove, it will be apparent to one of skill in the art that various changes in, for example, the type of feed table, the source of the suction, the type of drive gears, and the like could be made without departing from the true spirit and scope of the present invention which is accordingly to be limited only bye the appended claims.

What is claimed is:

1. A device for aligning sheets transversely with respect to a sheet running direction comprising:

a sheet support including a side register mark;

a suction roller positioned at a fixed distance above said sheet support during transverse alignment of the sheets and having a length and a longitudinal axis of rotation both extending in the sheet running direction;

means for driving said suction roller for continuous rotation about said longitudinal axis of rotation through less than one revolution during engagement of said suction roller with each successive sheet to be aligned against said side register mark; and a plurality of sheet holding surface segments spaced from each other on a circumference of said suction roller, each said sheet holding surface segment having a longitudinal distance in the sheet running direction, and having a transverse distance in a direction of said circumference of said suction roller and transverse to the sheet running direction, said longitudinal distance of said sheet holding surface segment of said suction roller being greater than said transverse distance of said sheet holding surface segment by a ratio of at least 3 to 1, said transverse distance being less than said circumference of said suction roller, successive ones of said sheet holding surface segments spaced on said circumference of said suction roller being in engagement with successive ones of the sheets supported on said sheet support to move each successive sheet on said sheet support transversely to said sheet running direction and into engagement with said side register mark.

2. The device of claim 1 further including first, second and third sheets being arrangable along said length of said suction roller while being aligned transversely to the sheet running direction.

3. The device of claim 1 wherein:

said sheet transport suction roller is rotated though one half a revolution for each sheet to be aligned against said side register mark.

4. The device of claim 1 wherein said ratio is greater than 5.

5. The device of claim 1 wherein said sheet support is a feed table.

6. The device of claim 1 wherein said suction roller has spaced suction hole segments on a peripheral surface and alternating spaced non-suction hole segments, and further including a stationary pipe supporting said suction roller for rotation, means supplying suction air to said stationary pipe, and a narrow suction slit on said stationary pipe, said narrow suction slit being alignable with said suction holes to define a narrow suction strip of said suction holes charged with suction.

7. The device of claim 1 further including means for moving sheets from said sheet support in the sheet running direction with a lateral offset.

8. The device of claim 6 further including a tolerance strip defined by an edge of a sheet entering said sheet support, said narrow suction strip being arranged between said tolerance strip and lateral offset edges of sheets supported by said sheet support.

9. The device of claim 1 further including a suction roller drive.

10. The device of claim 1 wherein said means for driving said suction roller include bevel drive gears and a drive shaft rotatably supported transverse to said suction roller and beneath said sheet support.

11. The device of claim 1 further including a flexible belt above said sheet support, said flexible belt driving said suction roller for rotation.

12. A method for aligning sheets transversely to a sheet running direction including;

providing a sheet support;

positioning sheet side register marks on said sheet support;

arranging at least first, second and third sheets in a scaled manner on said sheet support in the sheet running direction;

providing a suction roller having a longitudinal axis;

providing a drive for said suction roller;

supporting said driven suction roller for continuous rotation at a fixed distance above said sheet support and about said longitudinal axis extending in the sheet running direction;

moving said first, previously aligned sheet in the sheet running direction and transversely away from said sheet side register marks;

concurrently grasping said second one of said sheets from above using said continuously rotating, driven suction roller and moving said second sheet transversely to the sheet running direction beneath said first sheet into engagement with said sheet side register marks during said grasping of said second sheet by said suction roller; and concurrently supporting said third one of said sheets on said sheet support and transporting said third one of said sheets in the sheet running direction beneath said second sheet during grasping of said second sheet by said suction roller and during said moving of said second sheet transversely to the sheet running direction and into engagement with said side register marks by said continuous rotation of said driven suction roller.

* * * * *